United States Patent [19]

Kawaguchi

[11] Patent Number: 4,457,231

[45] Date of Patent: Jul. 3, 1984

[54] PHASE ADJUSTING APPARATUS OF SHEET-FED ROTARY PRINTING PRESS WITH TURN-OVER MECHANISM

[75] Inventor: Shoichi Kawaguchi, Ibaragi, Japan

[73] Assignee: Komori Printing Machinery Co., Ltd., Sumida, Japan

[21] Appl. No.: 435,820

[22] Filed: Oct. 21, 1982

[30] Foreign Application Priority Data

Oct. 24, 1981 [JP] Japan ..... 56-170278

[51] Int. Cl.[3] ..... B41F 21/10; B41F 13/12

[52] U.S. Cl. ..... 101/230; 101/248

[58] Field of Search ..... 101/248, 181, 230, 231; 74/395, 409, 439, 440, 441, 444

[56] References Cited

U.S. PATENT DOCUMENTS

| | | | |
|---|---|---|---|
| 1,839,722 | 1/1932 | Aitchison | 101/248 |
| 3,793,899 | 2/1974 | Bourbonnaud | 74/409 |
| 4,122,773 | 10/1978 | Wirz | 101/230 |

FOREIGN PATENT DOCUMENTS

| | | | |
|---|---|---|---|
| 269381 | 4/1927 | United Kingdom | 101/248 |
| 502034 | 3/1939 | United Kingdom | 101/248 |

*Primary Examiner*—J. Reed Fisher

*Attorney, Agent, or Firm*—Thompson, Birch, Gauthier & Samuels

[57] ABSTRACT

In a phase adjusting apparatus for use in a sheet-fed rotary printing press having a turn-over mechanism, there are provided a fixed gear meshing with a gear of a printing cylinder on the downstream side and secured to an end shaft of a turn-over cylinder in contact with two adjacent printing cylinders, an adjusting gear meshing with a gear of a printing cylinder on the upstream side and loosely mounted on the shaft, and radial two-armed levers pivotally mounted on a fixed gear and engaging an adjusting bolt coaxial with a turn-over cylinder, and pins inserted into openings of the fixed gear to engage the two-armed levers. With this construction it is possible to readily adjust the phase relationship between groups of cylinders on the upstream side and downstream side of the turn-over cylinder.

2 Claims, 8 Drawing Figures

PHASE ADJUSTING APPARATUS OF SHEET-FED ROTARY PRINTING PRESS WITH TURN-OVER MECHANISM

BACKGROUND OF THE INVENTION

This invention relates to apparatus for adjusting phases of cylinders for transferring sheets in a sheet-fed rotary printing press provided with a sheet turn-over mechanism for printing both sides of the sheet.

In recent years, there has been developed a sheet-fed rotary printing press provided with a turn-over mechanism so that it can print one side or both sides of a sheet. FIGS. 1 and 2 are side views of the printing press near its turn-over cylinder and are useful to explain the sheet transfer operation of the printing press of this type at the time of printing one side and at the time of printing both sides of the sheet. FIG. 1 shows one side printing, while FIG. 2 both side printing. More particularly, a turn-over cylinder 2 is provided on the downstream side of an impression cylinder 1 of a first printing unit, and an impression cylinder 3 of a second printing unit is provided on the downstream side of the turn-over cylinder 2. A sheet 5 printed between the impression cylinder 1 and a blanket cylinder 4 of the first printing unit is sent between the impression cylinder 3 and a blanket cylinder 6 of the second printing unit via the turn-over cylinder 2 by the operation of gripper-to-gripper transfer, so as to be subsequently printed. Comparing one side printing with both side printing, in the one side printing shown in FIG. 1, the sheet 5 with its front surface 5*a* printed is released from grippers 7 of the impression cylinder 1 and then gripped by tumbler grippers 8. After the turn-over cylinder 2 has rotated about 180°, the sheet 5 is gripped by grippers 9 of the impression cylinder 3 to be subjected to the next printing. At this time, since the sheet wrapped about the impression cylinder 3 has its front surface 5*a* faced outward, one side printing is performed. On the other hand, in the case of the both side printing shown in FIG. 2, the upper surface 5*a* of the sheet 5 is printed while it passes between the impression cylinder 1 and the blanket cylinder 4 and the sheet 5 passes through a contact point between the turn-over cylinder 2 and the impression cylinder 1 while being gripped by grippers 7 so that the sheet 5 is wrapped about the impression cylinder 1. As the trailing end of the sheet 5 reaches the contact point between both impression cylinder 1 and turn-over cylinder 2, the trailing end is gripped by the tumbler grippers 8. At this time, the grippers 7 are opened to release the sheet 5 so that as the turn-over cylinder 2 rotates, the sheet 5 will be brought to the impression cylinder 3 under a reversed state and wrapped about the impression cylinder 3 with its upper surface 5*a* in contact with the impression cylinder 3 by the operation of the grippers, whereby its rear surface 5*b* is printed. In this case, different from the one side printing, the tumbler grippers 8 are advanced from the side of the trailing end of the sheet 5 to grip the sheet 5. After rotating with the turn-over cylinder 2, the grippers 8 release the sheet 5. Accordingly, cams for operating the grippers are provided with cam surfaces such that the tumbler grippers 8 rotate substantially 180° during one revolution.

With the printing press provided with such turn-over mechanism, as can be clearly understood by comparing FIGS. 1 and 2, grippers 7 and tumbler grippers 8 which oppose each other in FIG. 1, but in FIG. 2, grippers 7 and 8 are dephased by a wrap angle $\theta$ of the sheet 5, and by an angle $\alpha$ of the rotation of the tumbler grippers 8. Accordingly, when switching from the one side printing to the both side printing or vice versa, it is necessary to make different the phase of a group of cylinders, including the turn-over cylinder 2 and the following cylinders from the phase of a group of cylinders including the impression cylinder 1 and the following cylinders by an angle $\theta$ corresponding to the size of the sheet 5 and by an angle $\alpha$ of the rotation of the tumbler grippers 8. Further, it is also necessary to adjust the phases when the size of the sheet 5 varies during both side printing.

As the phase adjusting apparatus, the following apparatus have been generally used. More particularly, two adjacent gears meshing with a gear of the impression cylinder 1 are provided for the turn-over cylinder 2, one being fixed to the shaft of the turn-over cylinder 2 and the other being rotatably mounted on the shaft. During operation, the two gears are fixed together to transmit the rotation of the impression cylinder 1 to the turn-over cylinder 2, whereas for adjusting the phase, the two gears are separated, the rotatably mounted gear is rotated together with the group of cylinders including the impression cylinder 1 to position them, and thereafter the two gears are fixed together to transmit the rotation.

With the prior art phase adjusting apparatus, however, the two gears are fixed with 4 to 6 bolts and a clamping plate so that at each phase adjustment the bolts are loosened or tightened for separating or fixing the gears. This not only requires much time but also a large space for the adjustment.

SUMMARY OF THE INVENTION

Accordingly it is an object of this invention to provide phase adjacenting apparatus capable of readily adjusting, in a short time, the phase relation between groups of cylinders on the upstream and downstream sides of a turn-over cylinder.

According to this invention there is provided a phase adjusting apparatus for use in a sheet-fed rotary printing press having a turn-over mechanism in which a sheet to be printed is turned-over by a turn-over cylinder in contact with two adjacent printing cylinders, the apparatus comprising a fixed gear fixed to a shaft of the turn-over cylinder for meshing with a gear on a printing cylinder on the downstream side; an adjusting gear loosely mounted on a shoulder of the fixed gear for meshing with a gear mounted on a printing cylinder on the upstream side; an adjusting bolt adjustably threaded into an axial direction of the turn-over cylinder; a plurality of radially extending two-armed levers with one ends engaged with the adjusting bolt, the two-armed levers being pivoted to an outer surface of the fixed gear to be swingable in a direction of movement of the adjusting bolt; pins for urging and separating the adjusting gear to and from the fixed gear as the two-armed levers are swung, one ends of the said pins engaging free end of the two-armed levers; and spring members interposed between the two-armed levers and the fixed gear concentrically with the pins, the spring members urging the adjusting gear against the fixed gear when the adjusting gear is urged to the fixed gear by the pins.

DESCRIPTION OF THE PREFERRED EMBODIMENTS

Figure 1:
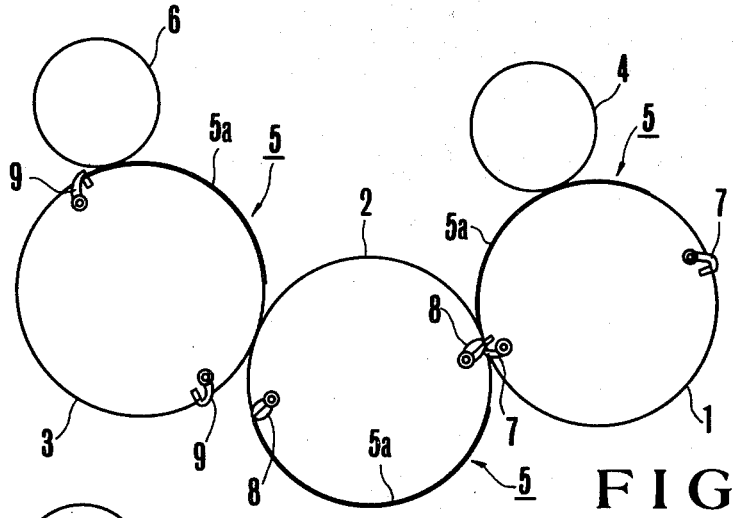
FIGS. 1 and 2 are side views near the turn-over cylinder of a sheet-fed rotary printing press having a turn-over mechanism and useful to explain the sheet gripping operation of the grippers at the time of one side printing and both side painting.

In a preferred embodiment of this invention shown in FIGS. 3 through 7, the arrangement of a turn-over cylinder and various cylinders about the same, and the turn-over operation are similar to those described in connection with FIGS. 1 and 2. In these drawings, blanket cylinders 4 and 6 acting as printing cylinders, and impression cylinders 1 and 3 having a diameter twice of that of the blanket cylinders 4 and 6 are journalled by opposite frames 10 of adjacent printing units with the peripheries of adjacent cylinders in contact with each other. The turn-over cylinder 2 having the same diameter as the impression cylinders 1 and 3 are journalled therebetween with the peripheries of adjacent cylinders in contact with each other. A plurality of grippers 7 and 9 are mounted in grooves on the peripheries of the impression cylinders 1 and 3. The grippers 7, 9 are opened and closed at predetermined timings when the cylinders 1 and 3 are rotated. Grip operating cams, not shown, are secured on the frames adjacent the ends of respective cylinders to actuate cam followers, not shown, for opening and closing the grippers 7, 9. A plurality of tumbler grippers 8 are mounted in the grooves on the periphery of the turn-over cylinder 2. The tumbler grippers 8 are opened, closed and turned over by causing cam followers mounted on the cylinders to selectively engage with the gripper operating cams, not shown, secured to the frames 10 and utilized for one side printing and combined gripper operating and turning over cams, not shown, for both side printing.

On an end shaft 11 projecting from the frame 10 positioned on the opposite side of the tumbler gripper drive is secured a fixed gear 12 to mesh with a gear secured to the shaft end of the impression cylinder 3 on the downstream side. The gear 12 is secured by a pair of tapered Ringfeder (trade name) locking devices 13*a* and bolts 13, the axial movement thereof being limited by a shoulder of the end shaft 11. An annular adjusting gear 14 meshing with a gear secured on the shaft end of the impression cylinder 1 on the upstream side is rotatably mounted on a shoulder 12*a* formed on the periphery of the fixed gear 12. The fixed gear 12 and the adjusting gear 14 are constructed such that their relative phase can be adjusted by a phase adjusting apparatus to be described later when switching is made between the one side printing and the both side printing. Fixing device 15 is provided for the purpose of securing the fixed gear 12 to the frame 10 so as not to rotate at the time of phase adjustment. The fixing device 15 is constituted by a bushing 17 received in a recess formed in one end surface of the fixed gear 12 and secured by bolts 16, a pin 19 slidably extending through the bushing 17 and the fixed gear 12, with end of the pin 19 received in an opening 18, and a compression spring 20 urging to withdraw the pin 19 from the opening 18. The bushing 17 is formed with a shallow groove 22 and a deep groove 23 adapted to engage a pin 21 provided for pin 19 so as to prevent withdrawal of the pin 19 when it is inserted into the opening 18 and then fixed and released.

Figure 5:
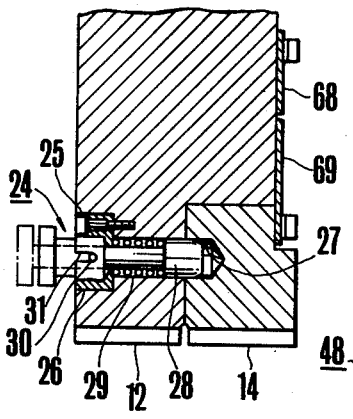
FIG. 5 is a sectional view taken along a line V—V in FIG. 3.

A fixing device for the fixing gear 12 and the adjusting gear at the time of the one side printing is designated by a reference numeral 24 shown in FIG. 5. The fixing device 24 comprises a bushing 26 received in a recess in one end surface of the fixed gear 12 and secured by bolts 25, a pin 28 slidably extending through the bushing 26 and the fixed gear 12, the end of the pin 28 being received by an opening 27 provided for the adjusting gear 14 and a compression spring 29 urging the pin 28 into the opening 27. The bushing 26 is provided with a groove 31 adapted to receive a pin 30 provided for the pin 28.

After withdrawing the pin 30 out of the groove 31 by pulling the pin 28 against the force of the compression spring 29, the pin 28 is rotated to cause the knock pin 30 to engage the end surface of the bushing 26 to prevent the pin 28 from moving into the opening 27.

Figure 4:
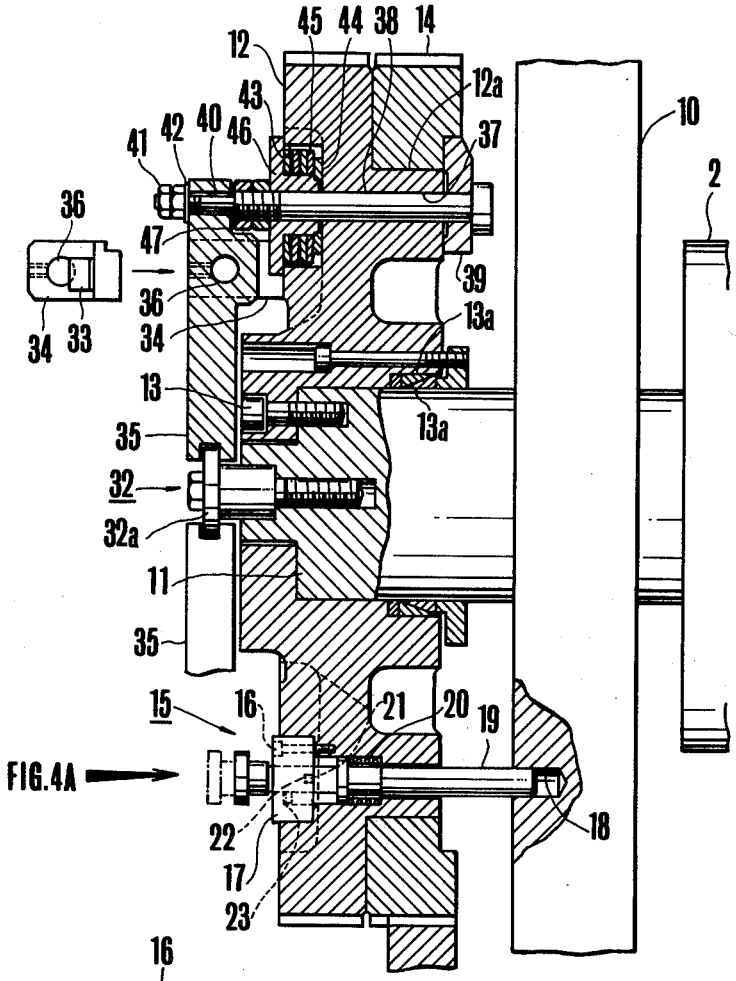
FIG. 4 is a sectional view taken along a line IV—IV in FIG. 3.
Figure 4A:
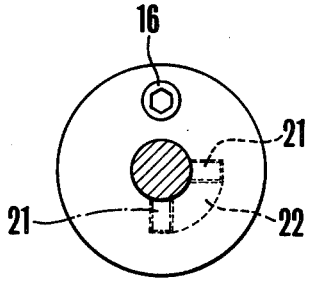
FIG. 4A is an enlarged side view of a fixing device.

The phase adjusting apparatus is constructed as follows. As shown in FIG. 4, an adjusting bolt 32 having a flange 32 is adjustably threaded into the end shaft 11 of the turn-over cylinder 2. 5 pairs of pin holders 34 secured to bolts 33 at equally spaced points of the end surface of the fixed gear 12. Radially extending two-armed levers 35 are pivotally supported by a pin 36 secured to each pair of holders 34. The bifurcated free end of each two-armed lever 35 engages the flange 32*a* of the adjusting bolt 32. Pins 38 with heads are inserted from the inner side of the adjusting gear into openings 37 formed on the peripheral portion of the fixed gear 12 and formed at portions corresponding to respective two-armed levers 35, and a clamping plate 39 is loosely interposed between the head of each pin 38 and an inner shoulder of the adjusting gear to abut against the inner shoulder of the fixed gear 12. Each pin 38 extends through an opening of the two-armed lever 35 and a double nut 41 is threaded on the outer end of the pin 38 through a washer 42. The diameter of the opening 40 is made to be slightly larger than that of pin 38, and the spacing between the washer 42 and the shoulder of the pin 38 is made to be slightly larger than the thickness of the lever 35 so as to permit swinging of the lever 35. On the front surface of the fixed gear 12 is formed a circular recess 43 concentric with pin 38. A hardened spacer 44 and four hardened springs 45 are received in the recess 43 and are clamped by the pin 38 through a flanged spacer 46 and the double nut 47 are threaded on the pin 38 between the spacer 46 and the two-armed lever 35. The dish shaped springs are stacked so that the front surfaces and the back surfaces of them are alternatively opposed with each other to make a resilient force. The spacer 44 and dish shaped springs 45 are loosely mounted on the boss of the flanged spacer 46. By adjusting the double nuts 47, the distance between the clamping plate 39 and the spacer 44 can be adjusted. With this construction, the pin 38 is spring-biased to the two-armed lever 35 by the resilient force of the dish springs 45 through the double nut 47 and the spacer 46 so that the clamping plate 39 strongly urges the adjusting gear 14 against the fixed gear 12. Each two-armed lever 35 is swung by adjusting the adjusting bolt 32 so as to urge the lever 35 against the double nuts 47 to compress the dish springs 45 to axially move the pin 38. Then, the clamping plate 39 is slightly separated away from the adjusting gear 14 to separate the adjusting gear 14 from the fixed gear 12.

Figure 3:
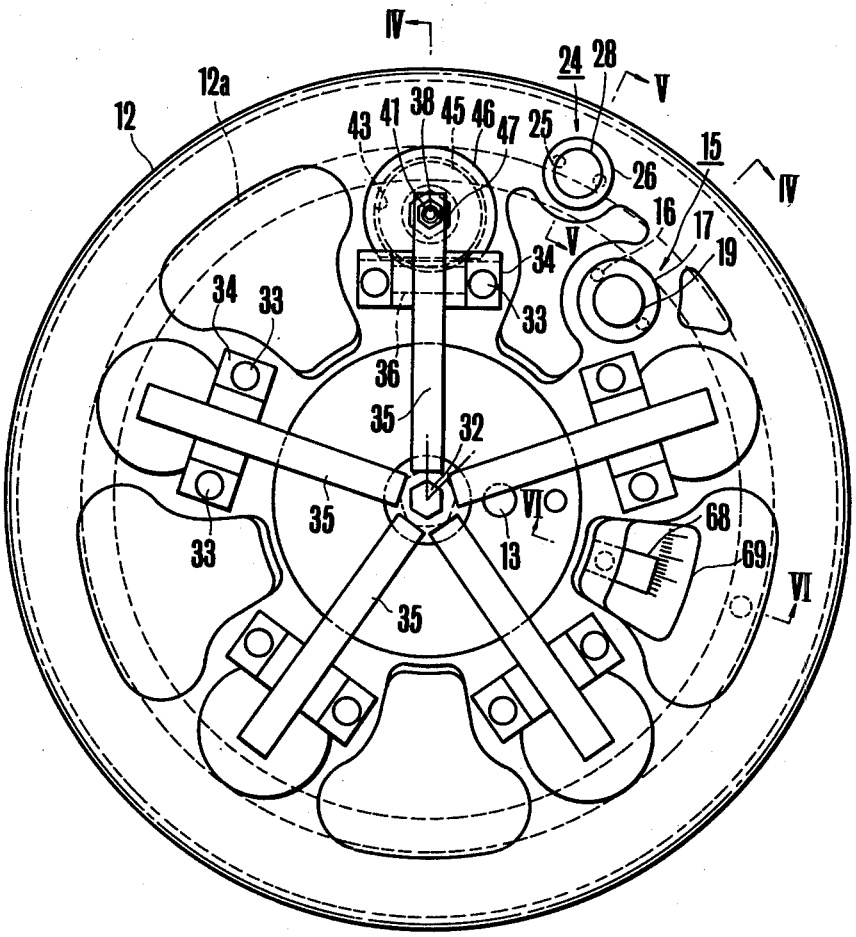
FIG. 3 shows one embodiment of the phase adjusting apparatus of a sheet-fed rotary printing press having a turn-over mechanism according to this invention; and particularly a front view viewed from the side of the shaft end of the turn-over cylinder.
Figure 6:
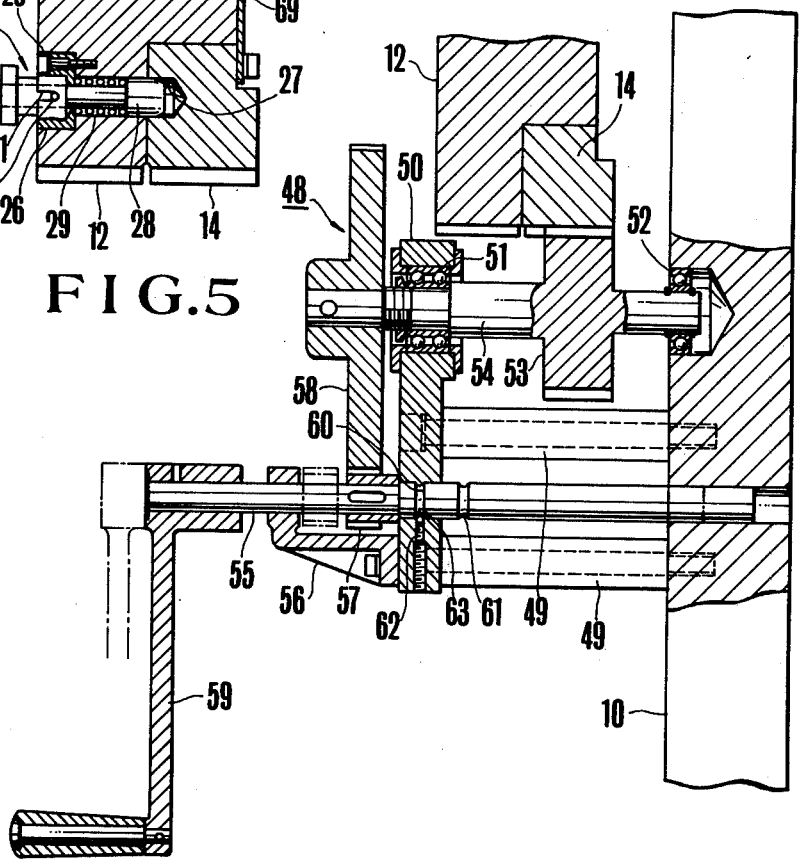
FIG. 6 is a longitudinal sectional view of the operating device of the phase adjusting apparatus along a line VI—VI in FIG. 3.

The phase adjusting apparatus is provided with an operating member 48 as shown in FIG. 6. A bearing 50 is located beneath gear 12 and supported by four stays 49 secured to the frames 10. The ball bearing 51 and a ball bearing 52 fitted in the frame 10 journal a shaft 54 integrally formed with a pinion 53 meshing with the adjusting gear 14. Between upper and lower stays 49 is rotatably journalled a handle shaft 55 which is supported by the frame 10 and a bracket 56 supporting the bearing 50. A pinion 57 keyed to the handle shaft 55 meshes with a gear 58 mounted on the shaft 54. A handle 59 is secured to the outer end of the handle shaft 55 which is formed with two annular grooves 60 and 61 to receive a ball 63 urged by a spring 62. The ball 63 and the spring 62 constitute a click mechanism to lock the pinion 57 at the meshing position and the disengaged position shown by solid lines and dotted lines in FIG. 6. With the pinion 57 and the gear 48 engaged, as the handle 59 is rotated the adjusting gear 14 is rotated to adjust its phase with respect to the fixed gear 12. As shown in FIG. 3, a pointer 68 and a scale board 69 are provided for the opposing surfaces of the fixed gear 12 and the adjusting gear 14.

The printing cylinder and the phase adjusting apparatus described above operate as follows. In the case of the one side printing, the fixing pin 28 is inserted into the opening 27 by the force of the compression spring 29 so that the pin 30 engages with groove 31 to align the fixed gear 12 and the adjusting gear 14 at a predetermined phase. The adjusting bolt 32 at the end shaft 11 of the turn-over cylinder 2 is tightened so that the pin 38 can slide with respect to the two-armed lever 35 by a gap between the washer 42 and the pin 38. As a consequence, the pin 38 is urged toward the lever 35 by the resiliency of the dish washers 45 and the adjusting gear 14 is strongly urged against the fixed gear 12 by the dish springs 45 via the clamping plate 39. The cam followers on the opposite end of the turn-over cylinder 2 cooperate with the gripper operating cams for the one side printing. Further, the operating handle shaft 55 may be pulled outwardly so that the pinion 57 is disengaged from the gear 58. The handle shaft 55 is provided with such safety device as a limit switch so as to prevent the machine from being started while the handle shaft 55 is withdrawn.

Figure 2:
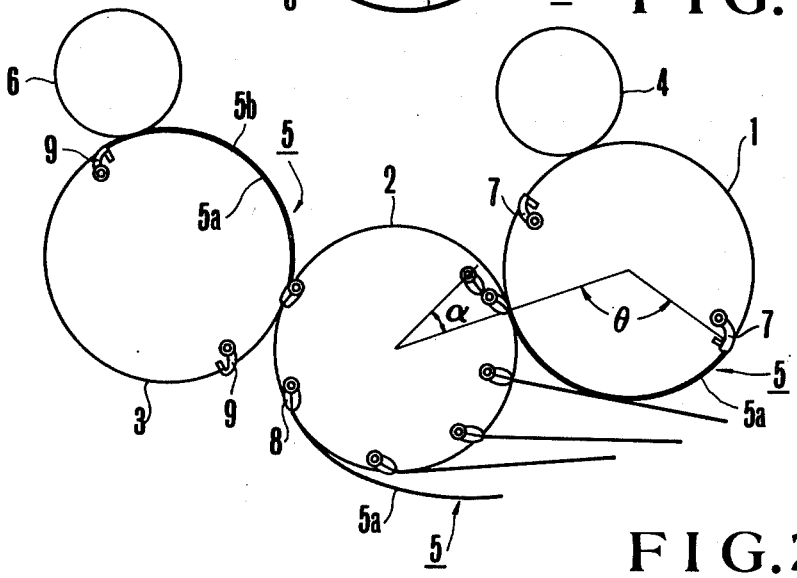

Then, when the machine is operated, as shown in FIG. 1, the sheet 5 with its front surface already printed between the blanket cylinder 4 and the impression cylinder 1 is wrapped about the turn-over cylinder 2 by the operation of the grippers 7 and 8 and the front surface 5*a* of the sheet 5 is faced outward by the tumbler grippers 8 and the grippers 9. Then, the sheet 5 is wrapped about the impression cylinder 3 so that the front surface 5*a* is printed again between the blanket cylinder 6 and the impression cylinder 3 thereby accomplishing the one side printing.

To switch the printing operation from the one side printing to the both side printing, the fixing pin 19 is pushed into an opening 18 of the frame 10 against the force of the compression spring 20 and then turned so as to bring the pin 21 into alignment with the shallow groove 22. Thus, the fixed gear 12 is secured not to prevent phase adjustment. Then the fixing pin 28 is withdrawn from the opening 27 and rotated against the force of the compression spring 29 so as to cause the knock pin 30 to engage the outer surface of the bushing 26, thus fixing the fixing pin 28 in a state when it is withdrawn from the opening 27. After that, the adjusting bolt 32 is loosened, and the lever 35 engaging the shoulder 32*a* of the adjusting bolt 32 is swung about the pivot pin 36 to move pin 38 by the leverage of the lever 35. At this time, since the force applied on the adjusting bolt 32 is larger than the force of the dish springs 45, these springs are compressed to slightly separate the clamping plate 39 from the adjusting gear 14 to disengage the same from the fixed gear 12. Thereafter, the handle shaft 55 is pushed inwardly, to mesh pinion 57 with the gear 58 so as to rotate the adjusting gear 14 through pinion 53, thus adjusting the phase between the fixed gear 12 and the adjusting gear 14. At the time of such adjusting, since the position of the trailing end of the sheet 5 differs depending upon its size and hence the angle $\theta$ shown in FIG. 2 differs. Such differences are corrected with the aid of the pointer 68 and the scale board 69. After the correction, the adjusting bolt 32 is tightened to firmly urge the adjusting gear 14 against the fixed gear 12. Then, the fixing gear 19 is withdrawn to cause the pin 21 to engage the deep groove 23. Furthermore, the handle shaft 55 is moved to disengage the pinion 57 from gear 58, thus completing the phase adjustment.

When the machine is operated under this condition, the phase of a group of cylinders on the upstream side including the impression cylinder 1 is made different from that of another group of cylinders including the turn-over cylinder 2. In addition, the cam followers on the opposite side of the turn-over cylinder 2 cam to face the gripper operating cams and the turn-over cam for the both side printing, the sheet 5 with its front surface printed between the impression cylinder 1 and the blanket cylinder 4 would be wrapped about the impression cylinder 1 by angle $\theta$ after passing therebetween, and the trailing end of the sheet is gripped by the tumbler grippers 8 at this position. As the groups of cylinders rotate further, the sheet 5 is turned over so that its front surface faces inward to reach the contact point with the impression cylinder, at which time the sheet is gripped by grippers 9 with its rear surface 56 faced outward. Thus, the rear surface is printed between the impression cylinder 3 and the blanket cylinder 6 to accomplish the both side printing.

The phase adjustment can be performed readily in a short time by inserting or withdrawing the fixing pins and by simultaneously moving a number of pins by the rotation of only one adjusting bolt.

Figure 7:
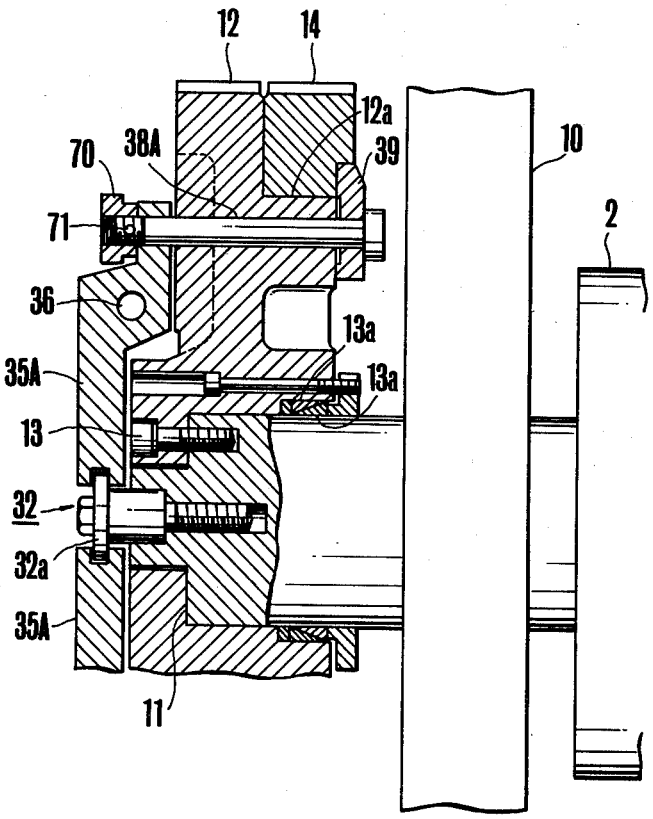
FIG. 7 is a sectional view showing a modified embodiment of this invention, which corresponds to FIG. 2.

In a modified embodiment shown in FIG. 7, a pin 38A with a head and extending through a fixed gear 12 is fitted with a clamping plate 39 in the same manner as in the first embodiment. The pin 38A extends through a two-armed lever 35A and, an adjusting nut 70 is threaded on the projecting end of the pin 38A and secured by a pin 71. The other elements are identical to those of the first embodiment.

With this modification, when the adjusting bolt 32 is tightened, the two-armed lever 35A is swung to move the pin 38A toward the two-armed lever 35A so that the clamping plate 39 urges the adjusting gear 14 to the fixed gear 12. When the adjusting bolt 32 is loosened, the two-armed lever 35A swings in the opposite direction so as to form a predetermined small gap between the two-armed lever 35A and the adjusting nut 70, thus permitting the pin 38A to move slightly in the axial direction, whereby the pressure caused by the clamping plate 39 is removed so as to permit relative rotation of the fixed gear 12 and the adjusting gear 14. Other operations are the same as in the first embodiment. The second embodiment enables the phase adjustment with a simple operation and has a simpler construction than the first embodiment.

As above described, in the phase adjusting apparatus of this invention for use in a sheet-fed rotary printing press having a turn-over mechanism, a stationary gear meshing with a gear of a printing cylinder on the downstream side is secured to the end shaft of a turn-over cylinder with its periphery contacted with the two adjacent printing cylinders, an adjusting gear meshing with a gear of a printing cylinder on the upstream side is loosely mounted on the shaft, and radial two-armed levers pivotally mounted on a fixed gear and engaging an adjusting bolt coaxial with a turn-over cylinder are engaged with pins inserted into openings of the fixed gear. Accordingly, when the two-armed levers are swung by the loosening and tightening of the adjusting bolt, the adjusting gear is urged against or separated from the fixed gear by the action of a spring member or an engaging member at the projecting end of the pin. Accordingly, the relative phase between a group of cylinders on the upstream side including the upstream printing cylinder and a group of cylinders on the downstream side including a turn-over cylinder can be readily adjusted in a short time by an operation at the axis of the turn-over cylinder. This not only improves workability but also decreases the operating space.

What is claimed is:

1. Phase adjusting apparatus for use in a sheet-fed rotary printing press having a turn-over mechanism in which a sheet to be printed is turned-over by a turn-over cylinder in contact with two adjacent printing cylinders, said apparatus comprising:

a fixed gear fixed to a shaft end of said turn-over cylinder for meshing with a gear on a printing cylinder on the downstream side;

an adjusting gear loosely mounted on a shoulder of said fixed gear for meshing with a gear mounted on a printing cylinder on the upstream side;

an adjusting bolt adjustably threaded into an axial direction of said turn-over cylinder;

a plurality of radially extending two-armed levers with one end of each of said levers engaged with said adjusting bolt, said two-armed levers being pivoted to an outer surface of said fixed gear to be swingable in a direction of movement of said adjusting bolt;

pins for urging and separating said adjusting gear to and from said fixed gear as said two-armed levers are swung, one end of each of said pins engaging a free end of each of said two-armed levers; and spring members interposed between said two-armed levers and said fixed gear concentrically with said pins, said spring members urging said adjusting gear against said fixed gear when said adjusting gear is urged against said fixed gear by said pins.

2. Phase adjusting appartus according to claim 1, wherein said apparatus comprises:

each of said pins being slidably inserted into each of openings of said fixed gear, said pins being caused to slide by the swinging motion of said levers in one direction for separating said adjusting gear from said fixed gear; and engaging members secured to portions of said pins protruding from said levers so as to engage said levers when they swing in the other direction thereby urging said adjusting gear against said fixed gear.

* * * * *